US009510110B2

(12) United States Patent
Lee et al.

(10) Patent No.: US 9,510,110 B2
(45) **Date of Patent: *Nov. 29, 2016**

(54) OPEN TOP BACK PLATE OPTICAL MICROPHONE

(71) Applicant: Apple Inc., Cupertino, CA (US)

(72) Inventors: Jae H. Lee, Palo Alto, CA (US); Janhavi S. Agashe, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/611,948

(22) Filed: Feb. 2, 2015

(65) Prior Publication Data

US 2016/0007125 A1 Jan. 7, 2016

Related U.S. Application Data

(60) Provisional application No. 62/021,624, filed on Jul. 7, 2014.

(51) Int. Cl.

| | |
|---|---|
| ***H04R 25/00*** | (2006.01) |
| ***H04R 23/00*** | (2006.01) |
| ***H04R 31/00*** | (2006.01) |
| *H04R 7/18* | (2006.01) |

(Continued)

(52) U.S. Cl.

CPC ..... *H04R 23/008* (2013.01); *H04R 31/003* (2013.01); *H04R 7/18* (2013.01); *H04R 2201/003* (2013.01); *H04R 2231/003* (2013.01); *H04R 2307/207* (2013.01)

(58) Field of Classification Search

CPC ..... H04R 23/008; H04R 2201/003

See application file for complete search history.

(56) References Cited

U.S. PATENT DOCUMENTS 6,154,551 A * 11/2000 Frenkel ..... H04R 23/008 381/160

7,134,343 B2 * 11/2006 Suzuki ..... G01H 9/00 356/499

(Continued)

FOREIGN PATENT DOCUMENTS

| | | |
|---|---|---|
| DE | 102012200957 | 1/2013 |
| EP | 1500913 | 1/2005 |

OTHER PUBLICATIONS

Bicen, B., et al., "Optical Microphone", *Micromachined Sensors and Transducers Laboratory* (*MIST*), Retrieved via Internet at old.me.gatech.edu/mist/microphone.htm on Mar. 13, 2014, 2 pages.

(Continued)

*Primary Examiner* — Quoc Tran
*Assistant Examiner* — Ryan Robinson
(74) *Attorney, Agent, or Firm* — Blakely, Sokoloff, Taylor & Zafman LLP

(57) ABSTRACT

A micro-electro-mechanical system (MEMS) optical sensor and method of manufacturing a MEMS optical sensor. The MEMS optical sensor may be a MEMS optical microphone including a compliant membrane configured to vibrate in response to an acoustic wave, the compliant membrane having a grating suspended therein. The optical sensor further including a back plate positioned above the compliant membrane, the back plate having a reflector suspended within a center portion of the back plate and aligned with the grating. The optical sensor further including a light emitter positioned below the compliant membrane and configured to transmit a laser light toward the grating and the reflector. The optical sensor also including a light detector configured to detect an interference pattern of the laser light after reflection from the reflector, wherein the interference pattern is indicative of an acoustic vibration of the compliant membrane. Other embodiments are also described and claimed.

20 Claims, 9 Drawing Sheets

(56) References Cited

U.S. PATENT DOCUMENTS

| | | | | |
|---|---|---|---|---|
| 7,277,642 | B2 * | 10/2007 | Shinzou | H04R 23/008 398/132 |
| 7,518,737 | B2 | 4/2009 | Hall et al. | |
| 8,261,602 | B2 | 9/2012 | Degertekin | |
| 8,503,701 | B2 | 8/2013 | Miles et al. | |
| 2002/0039463 | A1 | 4/2002 | Degertekin et al. | |
| 2004/0130728 | A1 * | 7/2004 | Degertekin | G01B 11/026 356/505 |
| 2005/0195400 | A1 | 9/2005 | Anderson et al. | |
| 2007/0028695 | A1 | 2/2007 | Suzuki et al. | |
| 2007/0165896 | A1 * | 7/2007 | Miles | H04R 23/008 381/356 |
| 2013/0142519 | A1 * | 6/2013 | Iwamoto | H04R 23/008 398/133 |
| 2014/0084394 | A1 | 3/2014 | Je | |
| 2014/0210020 | A1 * | 7/2014 | Dehe | B81B 3/007 257/416 |

OTHER PUBLICATIONS

Suzuki, Kazuhiro, et al., "Novel MEMS Optical Microphone with Grating Diaphragm", *International Conference on Electrical Engineering* (*ICEE*), (2004), 4 pages.

Apple Inc., PCT Search Report and Written Opinion dated Sep. 4, 2015, PCT/US2015/036818.

Apple Inc., Non-Final Office Action mailed Mar. 23, 2016, U.S. Appl. No. 14/325,204.

Apple Inc., PCT Search Report and Written Opinion dated Sep. 16, 2015, PCT/US2015/036810.

Bicen, Baris , et al., "Integrated Optical Displacement Detection and Electrostatic Actuation for Directional Optical Microphones With Micromachined Biomimetic Diaphragms", *IEEE Sensors Journal*, vol. 9, No. 12, (Dec. 2009), 1933-1941.

Bicen, Baris , "Micromachined Diffraction Based Optical Microphones and Intensity Probes With Electrostatic Force Feedback", Retrieved from the Internet: smartech.gatech.edu/bitstream/handle/1853/41065/bicen_baris_201008_phd.pdf, (Aug. 1, 2010).

Hall, Neal A., et al., "Simulation of Thin-Film Damping and Thermal Mechanical Noise Spectra for Advanced Micromachined Microphone Structures", *Journal of Microelectromechanical Systems*, vol. 17, No. 3, (Jun. 2008), 688-697.

Kuntzman, et al., "Performance and Modeling of a Fully Packaged Micromachined Optical Microphone", *Journal of Microelectromechanical Systems*, vol. 20, No. 4, (Aug. 2011), 828-833.

* cited by examiner

OPEN TOP BACK PLATE OPTICAL MICROPHONE

CROSS-REFERENCE TO RELATED APPLICATIONS

This application claims the benefit of the earlier filing date of U.S. Provisional Patent Application No. 62/021,624, filed Jul. 7, 2014 and incorporated herein by reference.

FIELD

An embodiment of the invention is directed to a micro-electro-mechanical system (MEMS) device, more specifically, a MEMS optical microphone having a substantially open back plate with a reflective surface and a grating formed in a diaphragm. Other embodiments are also described and claimed.

BACKGROUND

MEMS devices generally range in size from about 20 micrometers to about 1 millimeter and are made up of a number of even smaller components which can be formed in layers on a substrate using various MEMS processing techniques (e.g. deposition processes, patterning, lithography, etching, etc.). MEMS devices can be processed for many different applications, for example, they may be sensors or actuators. One example of a MEMS sensor is a laser microphone. A MEMS laser, or optical, microphone refers to a microphone which uses a laser beam to detect sound vibrations of an associated diaphragm. The microphone may include two essentially flat, horizontally arranged, surfaces. One of the surfaces may be a diaphragm, which can vibrate in response to sound waves, and the other surface may be a substantially stiff structure having a grating. A light emitter and a light detector may be associated with a substrate positioned below the flat surfaces. The light emitter may be a laser (e.g. a vertical cavity surface emitting laser (VCSEL)) configured to direct a light beam toward a reflective portion of the diaphragm. Typically, the substantially stiff structure having the grating is positioned between the diaphragm and the light emitter such that the light beam first passes through the grating. The light beam is diffracted by the grating and then reflected off of the reflective portion of the diaphragm back to the light detector. The light detector detects the interference pattern created by the diffracted light rays and converts the light into an electrical signal, which corresponds to an acoustic vibration of the diaphragm, which in turn provides an indication of sound.

SUMMARY

An embodiment of the invention is directed to a MEMS sensor which can be formed by MEMS processing techniques and includes one or more plates. Representatively, in one embodiment, the MEMS sensor is a very high signal-to-noise ratio (SNR) laser (or optical) microphone having a grating suspended in one plate and a reflector suspended in another plate. The plate having the grating may be a compliant membrane that serves as a microphone diaphragm. The plate having the reflector may be a substantially rigid back plate, which is positioned above or over the compliant membrane. The grating may be suspended within the compliant membrane by suspension members. The suspension members may help to reduce stress on the compliant membrane, and in turn, reduce, minimize, or perhaps eliminate, bowing of the grating. The back plate may include spokes which suspend the reflector within a center portion of the back plate. Both the compliant membrane and the back plate may include openings around the grating and the reflector, respectively, which allow for a coating (e.g. a gold coating) to be applied to the grating and the reflector, from above or the top of the back plate. Since the coating can be applied to both the grating and the reflector from the top structure, the compliant membrane and back plate can be formed from a single wafer (e.g. substrate), as opposed to separate wafers (one being a back plate and the other being a diaphragm) which are patterned into the desired plate or membrane or layer, and then attached together. The optical microphone may further include a light emitter and a light detector mounted to, or formed within, a substrate. The light emitter may be positioned such that it directs a light ray or beam toward the grating and reflector. The light detector may be positioned such that it detects an interference pattern of the laser light after reflection from the reflector.

A process for manufacturing a MEMS optical microphone may include providing a substrate and forming a compliant membrane over the substrate. A grating may further be formed in the compliant membrane. The process may further include forming a back plate over the compliant membrane. A center plate may be formed in the back plate. A reflective coating may be applied to the grating and the center plate by introducing a reflective coating material from a top side of, or above, the back plate.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
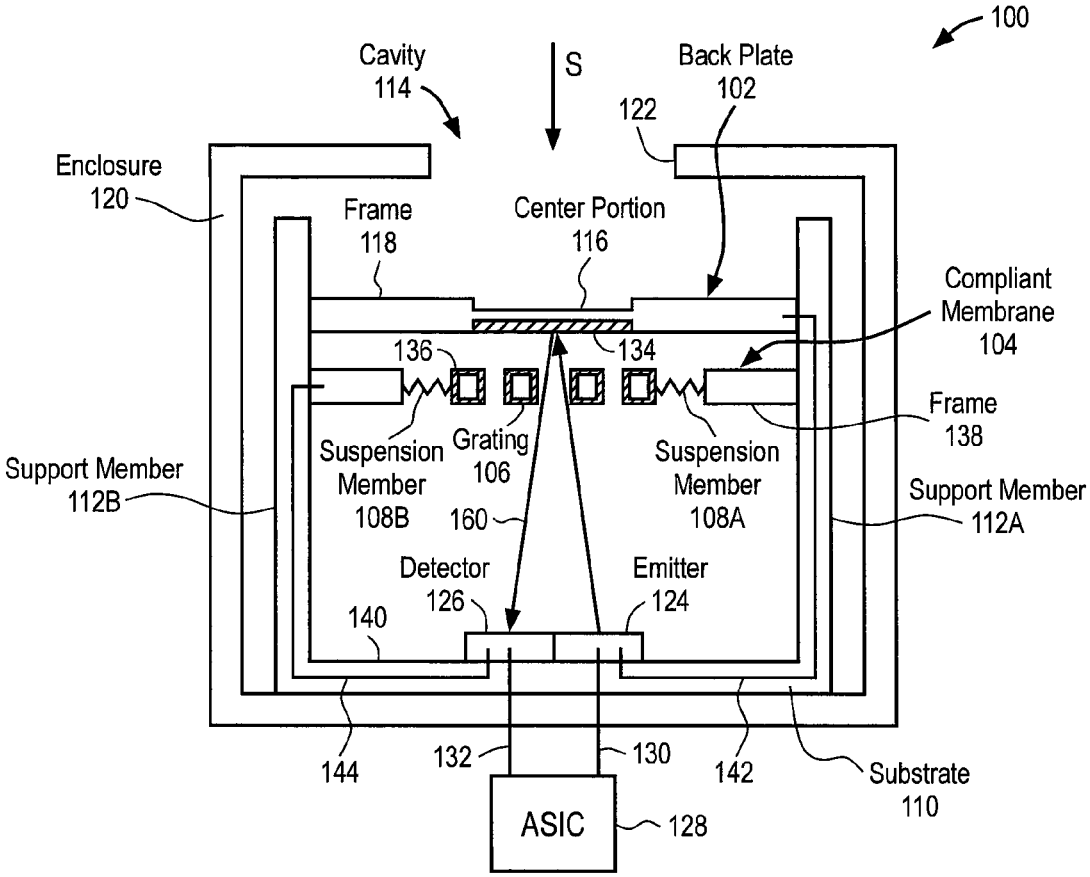
FIG. 1 illustrates a cross-sectional side view of one embodiment of a MEMS optical microphone.

FIG. 1 illustrates a cross-sectional side view of one embodiment of a MEMS optical microphone. Microphone 100 may include back plate 102 (also referred to herein as an upper or top plate), a compliant membrane 104 (also referred to herein as a lower or bottom plate), a light emitter 124, a light detector 126 and circuitry 128 formed on substrate 110. It should be understood that although back plate 102 may be referred to as a top plate, it may not be at the highest end of the microphone structure, rather, just higher than, for example, compliant membrane 104. Similarly, although compliant membrane 104 may be referred to as a bottom plate, it may not be at the lowest end of microphone structure, rather, just lower than, for example, back plate 102. Each of back plate 102 and compliant membrane 104 are parallel to one another and extend horizontally between vertically extending support members 112A or 112B of substrate 110. In one embodiment, vertically extending support members 112A and 112B may be sidewalls of a cavity 114 which is pre-formed within substrate 110 before each of back plate 102 and compliant membrane 104 are formed using MEMS processing techniques (e.g. deposition processes, patterning, lithography, etching, etc.). Back plate 102 and compliant membrane 104 may be fixedly attached to support members 112A and 112B at their ends such they maintain a fixed vertical position. In one embodiment, back plate 102 may be positioned over, or above, compliant membrane 104 and compliant membrane 104 may be positioned over, or above, substrate 110. In other words, compliant membrane 104 is positioned between back plate 102 and base portion 140 of substrate 110.

Back plate 102 may be a substantially rigid plate which provides a reflective surface for light emitted from light emitter 124. For example, back plate 102 may be made of a thick and stiff silicon plate. Back plate 102 is considered "rigid" relative to, for example, compliant membrane 104, which is not considered rigid, but rather compliant in that it can vibrate to achieve acoustic pick up as will be described in more detail below. Back plate 102 may be considered an upper plate or top plate because it is above compliant membrane 104. Back plate 102 may include an outer frame portion 118 and a center portion 116 which is suspended within frame portion 118. Center portion 116 and frame 118 may be within the same plane, in other words, within a plane of back plate 102. Center portion 116 may include a reflective surface 134 formed along a side facing light emitter 124. In this aspect, center portion 116 serves as a reflector for light emitted by light emitter 124 and may be referred to herein as a reflector. In some embodiments, the center portion 116 is made of a reflective material (e.g. metallic foil) while in other embodiments, reflective surface 134 is formed by application of a coating (e.g. metal coating such as gold) to center portion 116. Although reflective surface 134 is shown positioned only within center portion 116, it is contemplated that the reflective surface may extend beyond center portion. Back plate 102, including center portion 116 and reflective surface 134, may be built upon substrate 110 using MEMS processing techniques (e.g. deposition processes, patterning, lithography, etching, etc.).

Compliant membrane 104 may be positioned below back plate 102 (i.e. between back plate 102 and base portion 140 of substrate 110) and may therefore be considered a lower or bottom plate. Compliant membrane 104 may be configured to vibrate in response to sound (S) (acoustic waves) entering enclosure 120 through acoustic port 122. In this aspect, compliant membrane 104 may also be referred to as a diaphragm or sound pick up surface. Compliant membrane 104 may be made of any material and have any dimensions suitable to provide a semi-rigid or compliant membrane that vibrates in response to sound waves, for example, polysilicon.

Compliant membrane 104 may include a grating 106. Grating 106 may be vertically aligned with center portion 116 including reflective surface 134. In other words, grating 106 is aligned with the reflector formed within back plate 102. Grating 106 is also aligned with light emitter 124 and light detector 126 such that light emitted by light emitter 124 toward, and reflected from, reflective surface 134 of back plate 102 passes through grating 106. Grating 106 is dimensioned to form an interference pattern that can be detected by light detector 126 and used as an indicator of a movement of compliant membrane 104. Since the pattern represents a displacement of the compliant membrane 104, it can be used to provide an indication of sound using a diffraction based optical interferometer method or any other optical interferometric method. Representatively, in some embodiments, grating 106 may also include a reflective coating 136 to facilitate formation of the interference pattern.

Grating 106 may be suspended within compliant membrane 104 by suspension members 108A and 108B. Representatively, compliant membrane 104 may include a frame portion 138 having an open center. Grating 106 may be suspended within the open center by suspension members 108A and 108B. Suspension members 108A and 108B may be any type of suspension structure having some degree of elasticity such that a tension (e.g. outward pull) on grating 106 may be reduced, as compared to a membrane or plate having a grating that is not connected to the membrane or plate by a suspension member. Representatively, suspension members 108A and 108B may be spring type structures which can expand and contract in response to an outward tension on grating 106 which could be caused by compliant membrane 104. In this aspect, a bowing of grating 106, which can be caused by an outward tension, can be reduced, minimized or eliminated.

Compliant membrane 104, including grating 106 and suspension members 108A-108B, may be built upon substrate 110 using MEMS processing techniques (e.g. deposition processes, patterning, lithography, etching, etc.).

Microphone 100 may further include a light emitter 124 and a light detector 126. In some embodiments, light emitter 124 may be a light source such as a VCSEL that is electrically connected to substrate 110. Light emitter 124 may be configured to emit a laser light (or beam) in the direction of grating 106 and reflective surface 134, for detection by detector 126. Detector 126 may, in some embodiments, be a photo detector configured to detect a reflected light (or beam) generated by emitter 124. Emitter 124 and/or detector 126 may be mounted to, or formed from, substrate 110 using MEMS processing techniques.

Representatively, during operation, detector 126 detects light reflected off of grating 106 and reflective surface 134 to provide an indication of sound. In particular, compliant membrane 104 vibrates in response to sound (S). The vibration of compliant membrane 104 modulates an intensity of light 160 reflected off of the reflective surface 134 and grating 106 of compliant membrane 104. In addition, movement of compliant membrane 104 with respect to back plate 102 (which is rigid) causes an interference pattern formed by grating 106 to change in size. This modulation in intensity (i.e. change in size of the interference pattern) is detected by detector 126 and used as an indication of the movement of compliant membrane 104 and in turn, provides an indication of sound. It is further to be understood that in order to determine sound from the interference pattern, a distance between compliant membrane 104 and back plate 102 is set such that it is an integer multiple of ¼ λ of the light 160.

Microphone 100 may further include a circuit 128 (e.g. an application specific integrated circuit (ASIC)) electrically connected to light emitter 124 and light detector 126 by wiring 130, 132, respectively. In addition, circuit 128 may include wiring 142, 144 connected to back plate 102 and compliant membrane 104, respectively. Wiring 130, 132, 142, 144 may run through substrate 110 to the respective light emitter 124, light detector 126, back plate 102 and compliant membrane 104. In one embodiment, circuit 128 may be configured to receive power from an external source and apply a voltage to one or more of light emitter 124, light detector 126, back plate 102 and compliant membrane 104. For example, in one embodiment, wiring 142, 144 may be used to apply a voltage to one or more of back plate 102 and compliant membrane 104 to tune a distance (e.g. change the distance) between the back plate 102 and compliant membrane 104 so as to improve a resonance of an interference pattern used to provide an indication of sound, as will be discussed in more detail below.

Each of back plate 102 and compliant membrane 104, and in some cases emitter 124 and detector 126, may be built on substrate 110 using MEMS processing techniques. Substrate 110 may be mounted within a frame or enclosure 120. Enclosure 120 may include an acoustic port 122 through which sound (S) (also referred to as acoustic waves) can travel into microphone 100. Although acoustic port 122 is illustrated along a top side of enclosure 120, it could also be along a bottom side or side wall of enclosure 120 and therefore is not limited to the illustrated location.

Figure 2:
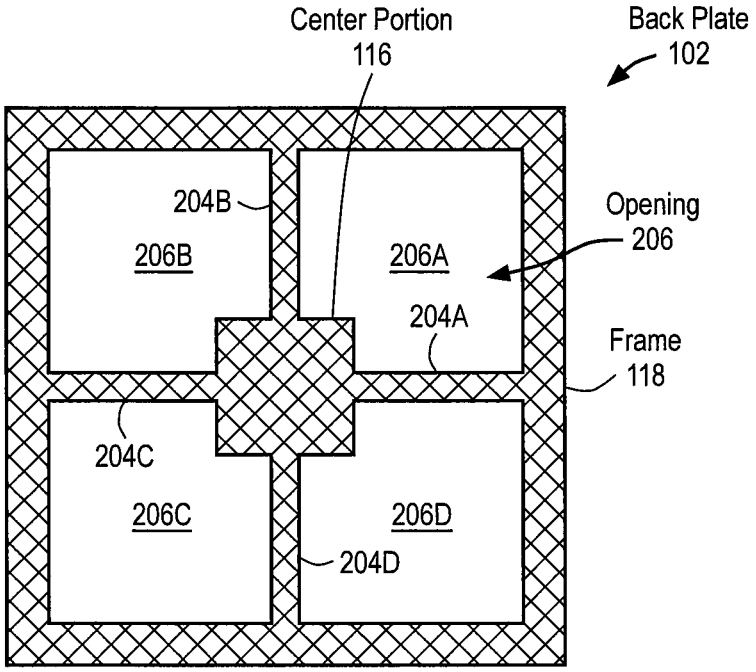
FIG. 2 illustrates a top plan view of a back plate of the MEMS optical microphone of FIG. 1.

FIG. 2 illustrates a top plan view of the back plate of the optical microphone of FIG. 1. From this view, it can be seen that back plate 102 may have a center portion 116 (such as an inner plate or center plate) suspended within an opening 206 of outer frame 118 by arms or spokes 204A, 204B, 204C and 204D. In this aspect, the area around center portion 116, and between spokes 204A-204D, is considered open. For example, openings 206A, 206B, 206C and 206D are formed between spokes 204A-204D and around center portion 116 such that back plate 102 is considered a substantially open structure. Each of frame 118, center portion 116 and spokes 204A-204D may be substantially rigid structures formed from a single back plate material layer (e.g. a silicon material layer). In this aspect, back plate 102 having frame 118, center portion 116 and spokes 204A-204D is considered a single, integrally formed structure. In addition, each of the frame 118, center portion 116 and spokes 204A-204D are all within the same plane. In this aspect, it should be understood that by referring to center portion 116 as being suspended within frame 118, center portion 116 is considered level with frame 118. Alternatively, center portion 116 could be suspended above or below frame 118 by spokes 204A-204D.

In one embodiment, center portion 116 is a substantially square shaped plate upon which the reflective surface 134 is applied. In this aspect, although center portion 116 is shown as a square shaped structure, center portion 116 may have any dimensions sufficient to reflect light generated by the light emitter. Representatively, in other embodiments, center portion 116 may have any type of quadrilateral shape, or other shapes, for example, a circle, ellipse, oval or the like. In the case of a square shaped center portion 116, each of spokes 204A-204D may extend from a respective side of center portion 116 to frame 118. Frame 118, may in turn, be a square shaped structure. Each of the sides of frame 118 may run parallel to a respective side of center portion 116. In other embodiments, spokes 204A-204D and frame 118 may be oriented in any manner with respect to center portion 116 that is sufficient to suspend center portion 116 above compliant membrane 104 and emitter 124/detector 126 as previously discussed. Representatively, spokes 204A-204D may extend from corners of center portion 116 to corners of frame 118.

Figure 3:
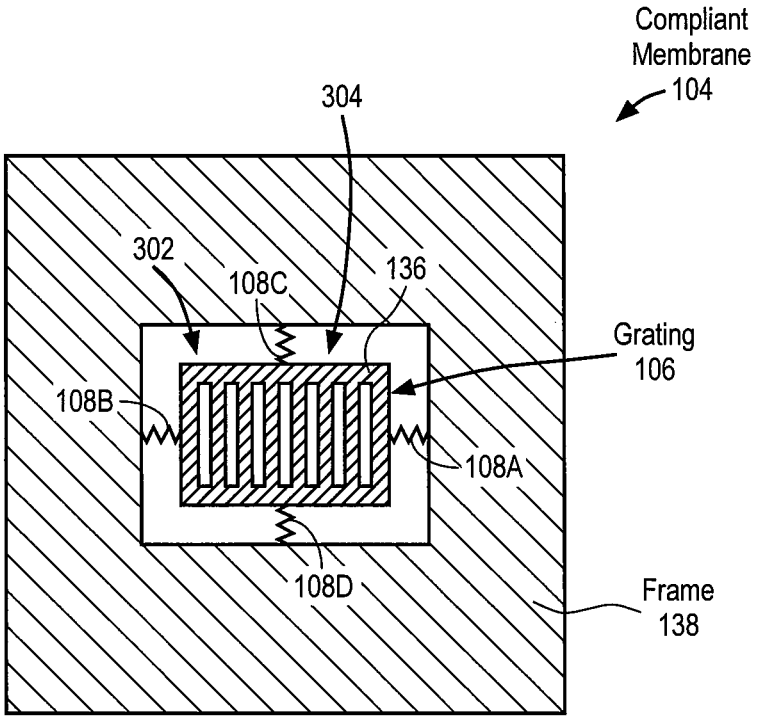
FIG. 3 illustrates a top plan view of a compliant membrane of the MEMS optical microphone of FIG. 1.

FIG. 3 illustrates a top plan view of a compliant membrane of the MEMS optical microphone of FIG. 1. From this view, it can be seen that compliant membrane 104 may have a similar size and shape as back plate 102, for example, a square shape. Alternatively, compliant membrane 104 may have any type of quadrilateral shape, or other shapes, for example, a circle, ellipse, oval or the like.

Grating 106 may be formed within a center portion of compliant membrane 104. Grating 106 may have a periodic structure sufficient to split and diffract light emitted from an emitter (e.g. emitter 124) into different beams for detection by a detector (e.g. detector 126). In some embodiments, the grating 106 causes the formation of an interference pattern which can be used to indicate a movement of compliant membrane 104 in response to sound waves, and in turn, as an indicator of sound. Grating 106 may be formed in a portion of compliant membrane 104 that is aligned with center portion 116 of back plate 102. For example, complaint membrane 104 may have an outer frame 138 with a center opening 302. Grating 106 may be coated with a reflective coating 136 and suspended within center opening 302 by suspension members 108A, 108B, 108C and 108D.

Suspension members 108A-108D may, in one embodiment, be spring type structures having an elasticity that helps to reduce a tension on grating 106. Representatively, in some cases, a grating within a plate or membrane can be subjected to an outward tension or pull that causes the grating to bow. Since suspension members 108A-108D have an elasticity, they can absorb this pull thereby reducing a tension on grating 106 and, in turn, possible bowing.

Suspension members 108A-108D can be made from the same compliant material layer used to form compliant membrane 104 and grating 106 such that the entire compliant membrane structure 104 is one integrally formed membrane. The material and/or dimensions of suspension members 108A-108D may be selected to provide elasticity to the members. For example, in one embodiment, suspension members 108A-108D may be corrugated structures which can expand and contract. In some embodiments, suspension members 108A-108D may be relatively narrow structures such that the area 304 between grating 106 and frame 138 remains substantially open to fluid flow, for example, a gas such as air or a liquid. It is noted that since air is free to flow through compliant membrane 104 (e.g. through grating 106 and the open area 304 around grating 106) and back plate 102 (e.g. through openings 206A-206D), there is less of a "squeeze film" effect. The squeeze film effect refers to a phenomenon that occurs when air passes between two plates in close proximity. As a result, the noise penalty due to the squeeze film effect is reduced.

Figure 4:
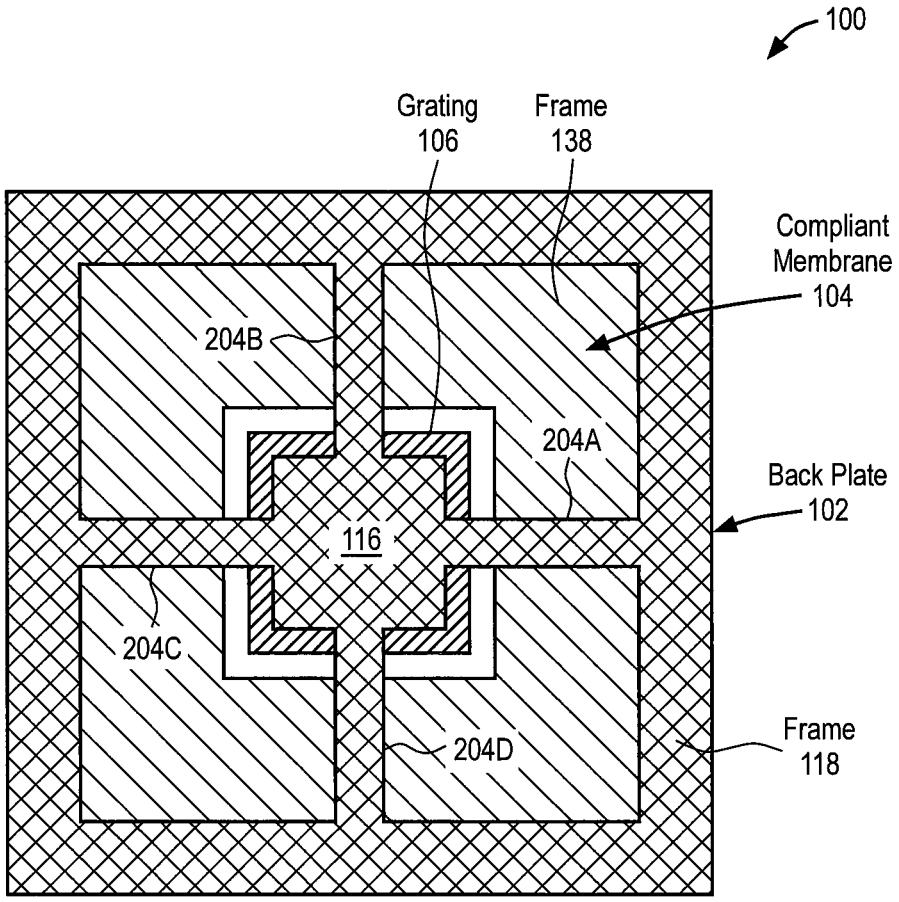
FIG. 4 illustrates a top plan view of the MEMS optical microphone of FIG. 1.

FIG. 4 illustrates a top plan view of the MEMS optical microphone of FIG. 1. From this view, it can be seen that visual alignment of the grating 106 of compliant membrane 104 and center portion 116 (which forms the reflective surface 134) of back plate 102, and in some cases light emitter 124, are possible through the top side of microphone 100. In particular, because a substantial portion of back plate 102 remains open around center portion 116, the underlying grating 106 can be viewed and aligned with center portion 116 from a top side of microphone 100. Back plate 102 can therefore be considered an "open top" back plate because it is on top of compliant membrane 104 and substantially open. In addition, in some embodiments, grating 106 is larger than center portion 116, and in turn the reflector formed by reflective surface 134, such that the location of grating 106 with respect to center portion 116 (i.e. the reflector) can be clearly seen from above. Said another way, when viewed from a top side as shown in FIG. 4, grating 106 has a larger overall profile or footprint than the reflector portion (i.e. center portion 116) such that the edges defining grating 106 can be viewed from above. In other words, the reflector has a smaller overall footprint than grating 106.

Figure 5A:
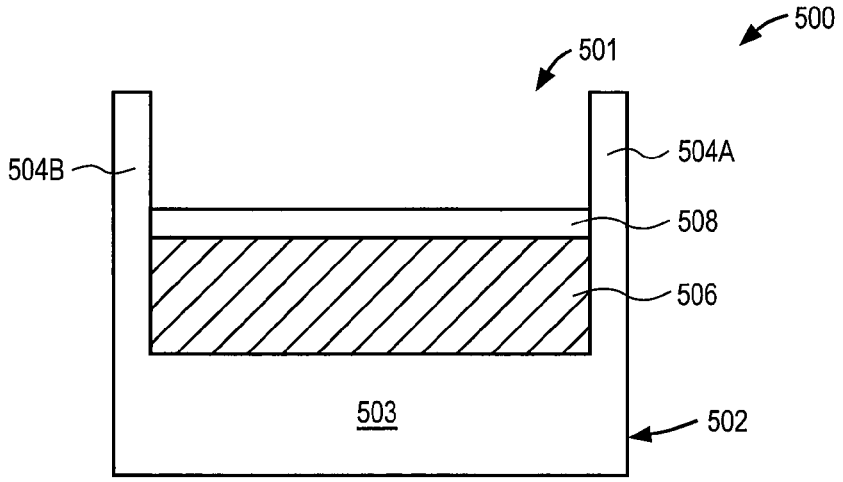
FIG. 5A illustrates one embodiment of a processing step for fabricating the optical microphone of FIG. 1.

FIG. 5A illustrates one embodiment of a processing step for fabricating the optical microphone of FIG. 1. FIG. 5A illustrates substrate 502 having a cavity 501 formed therein. Substrate 502 may be a silicon substrate, for example, a silicon on insulator (SOI) wafer. Cavity 501 may be defined by vertically extending support member 504A and vertically extending support member 504B and a base portion 503 of substrate 502. In one embodiment, cavity 501 is formed within substrate 502 using a MEMS etching process, for example, reactive ion etching (RIE). Alternatively, cavity 501 may be formed on top of substrate 502 by stacking additional material layers and then patterning the layers to form cavity 501. MEMS microphone 100 may be formed within cavity 501.

Representatively, in one embodiment, a sacrificial layer 506 may be formed on top of the base portion 503 of substrate 502. Sacrificial layer 506 may be formed by any MEMS processing technique suitable for forming a sacrificial layer. For example, sacrificial layer 506 may be formed by blanket depositing a sacrificial material over substrate 502 using a chemical vapor deposition (CVD) process and then planarizing the layer to provide a desired layer thickness. Sacrificial layer 506 may be made of any material that can be selectively removed or patterned using MEMS processing steps. Representatively, sacrificial layer 506 may be made of silicon dioxide or a silicate glass.

Compliant membrane layer 508 may be formed over sacrificial layer 506. Compliant membrane layer 508 may be formed by any MEMS processing technique suitable for forming a compliant membrane layer, for example, blanket depositing a compliant membrane layer material using CVD. Compliant membrane layer 508 may be made of any material suitable for forming a compliant membrane that vibrates in response to acoustic waves as previously discussed in reference to FIG. 1. Representatively, compliant membrane layer 508 may be made of a material capable of forming a membrane that can function as a microphone diaphragm (e.g. capable of vibrating in response to acoustic waves) or sound pick up membrane, for example, a polysilicon material.

Figure 5B:
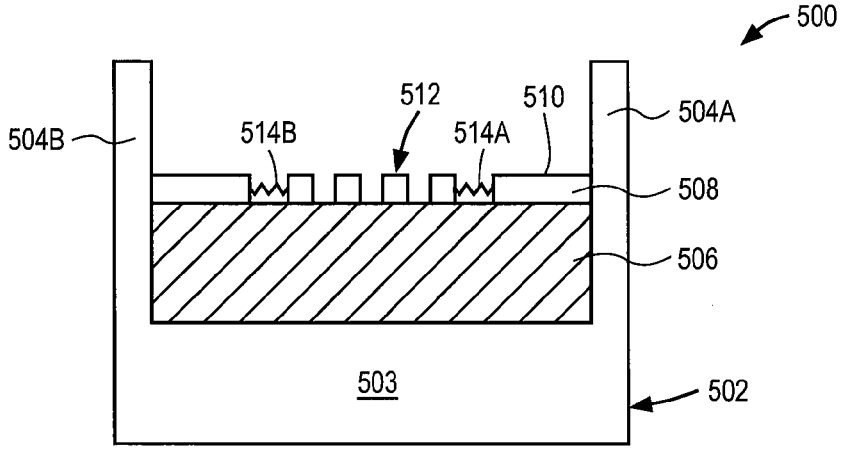
FIG. 5B illustrates one embodiment of another processing step for fabricating the optical microphone of FIG. 1.

FIG. 5B illustrates one embodiment of another processing step for fabricating the optical microphone of FIG. 1. FIG. 5B shows compliant membrane layer 508 after a processing step in which portions of compliant membrane layer 508 are removed to form a structure suitable for use as a compliant membrane within microphone 100. For example, compliant membrane layer 508 may be patterned using different etching steps (e.g. reactive ion etching) to have the shape and dimensions of compliant membrane 104 described in reference to FIG. 1. Representatively, where compliant membrane 508 is to be used as both a sound pick up surface (e.g. a microphone diaphragm) and a grating to form an interference pattern that can be detected by a light detector to provide an indication of a movement of compliant membrane 104, compliant membrane layer 508 is patterned to have grating 512 suspended with a frame portion 510 by suspension members 514A and 514B. Grating 512, frame portion 510 and suspension members 514A-514B may be formed using MEMS processing techniques such that they are substantially similar to grating 106, frame portion 138 and suspension members 108A-108B, respectively, previously discussed in reference to FIG. 1.

Figure 5C:
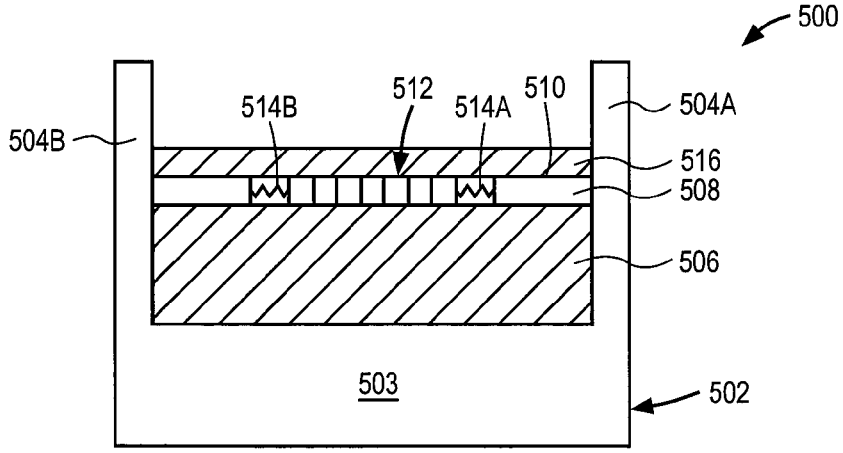
FIG. 5C illustrates one embodiment of another processing step for fabricating the optical microphone of FIG. 1.

FIG. 5C illustrates one embodiment of another processing step for fabricating the optical microphone of FIG. 1. FIG. 5C illustrates the step of forming a sacrificial layer 516 over compliant membrane layer 508. Sacrificial layer 516 may be formed using any MEMS processing step suitable for forming a sacrificial layer over another layer. For example, sacrificial layer 516 may be formed by blanket depositing a sacrificial layer material over compliant membrane layer 508 and sacrificial layer 506 using CVD. Sacrificial layer 516 may be substantially similar to sacrificial layer 506. Sacrificial layer 516 may be of any material that can be selectively removed during a further processing step (e.g. silicon dioxide or silicate glass).

Figure 5D:
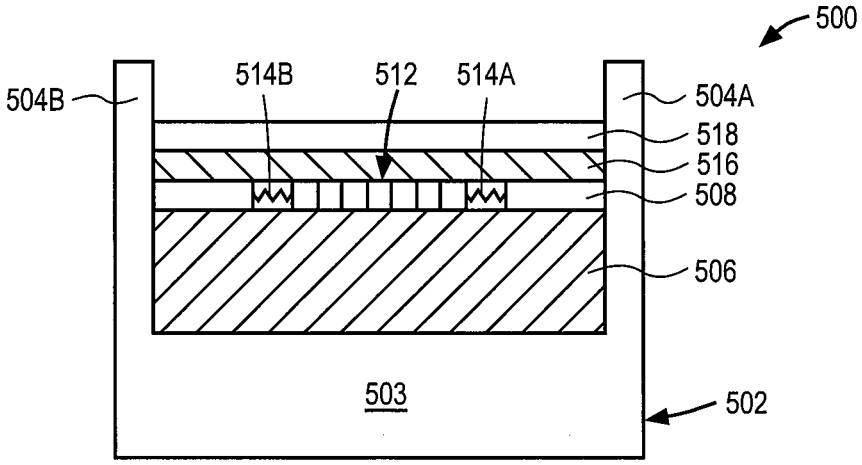
FIG. 5D illustrates one embodiment of another processing step for fabricating the optical microphone of FIG. 1.

FIG. 5D illustrates one embodiment of another processing step for fabricating the optical microphone of FIG. 1. FIG. 5D illustrates the step of forming a back plate layer 518 over sacrificial layer 516. Back plate layer 518 may be formed by any MEMS processing step suitable for forming a back plate layer over sacrificial layer 516. For example, back plate layer 518 may be formed by blanket depositing a back plate layer material over sacrificial layer 516 using CVD. A suitable back plate layer material may be, for example, a silicon material capable of forming a substantially rigid layer that can function as a substantially rigid reflective surface during operation of the microphone.

Figure 5E:
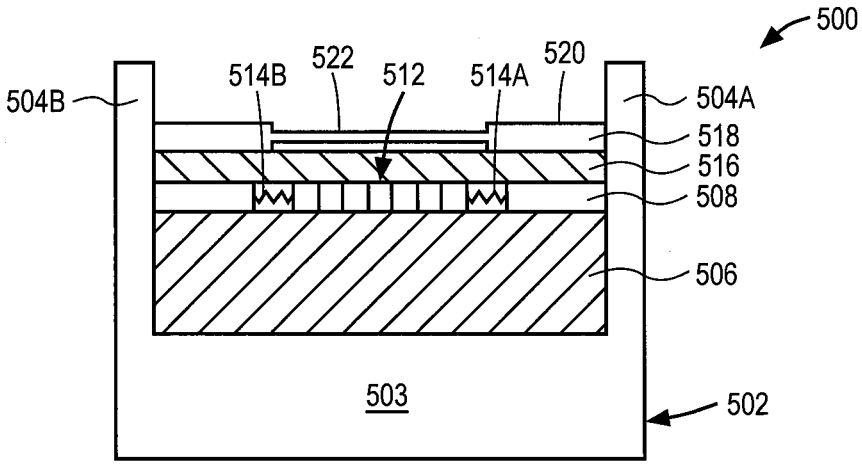
FIG. 5E illustrates one embodiment of another processing step for fabricating the optical microphone of FIG. 1.

FIG. 5E illustrates one embodiment of another processing step for fabricating the optical microphone of FIG. 1. FIG. 5E shows back plate layer 518 after a processing step in which portions of back plate layer 518 are removed to form a structure suitable for use as a back plate within microphone 100. For example, back plate layer 518 is processed using MEMS processing techniques to have the shape and dimensions of back plate 102 described in reference to FIG. 1. Representatively, an RIE processing technique may be used to pattern back plate layer 518 to include a frame portion 520 and center portion (or center plate) 522. Frame portion 520 and center portion 522 may be substantially similar to frame portion 118 and center portion 116 previously discussed in reference to FIG. 1. For example, the center portion 522 may be a plate suspended within an opening of frame 520 by spokes as previously discussed in more detail in reference to FIG. 2. In this aspect, once the sacrificial layers 516 and 506 are removed, a substantially open back plate layer 518 is formed over compliant membrane layer 508.

Figure 5F:
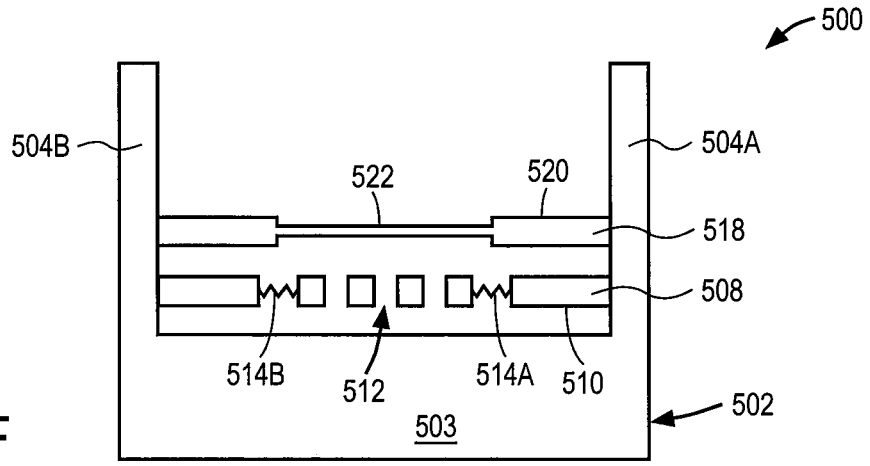
FIG. 5F illustrates one embodiment of another processing step for fabricating the optical microphone of FIG. 1.

FIG. 5F illustrates one embodiment of another processing step for fabricating the optical microphone of FIG. 1. FIG. 5F illustrates a processing step in which sacrificial layers 506 and 516 have been removed, for example, by a wet or dry etch processing technique. For example, layers 506 and 516 may be removed using a wet etching step with a selective wet etchant including hydrofluoric acid (HF). The wet etchant (HF) etches away sacrificial layers 506 and 516 without etching, or otherwise damaging, the various layers needed to form the microphone, for example, compliant membrane layer 508 and back plate layer 518. In some embodiments, an opening is formed through substrate 503 and the etchant is introduced through the opening to an underside of complaint membrane layer 508 and back plate layer 518, while in other embodiments the etchant is applied from above compliant back plate layer 518. The etchant reaches sacrificial layers 506 and 516 by flowing through the openings in back plate layer 518 and complaint membrane layer 508.

Figure 5G:
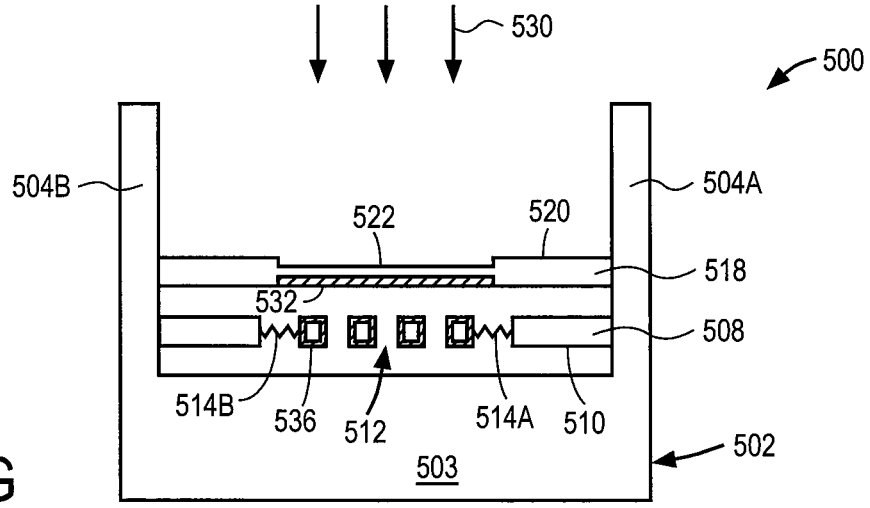
FIG. 5G illustrates one embodiment of another processing step for fabricating the optical microphone of FIG. 1.

FIG. 5G further illustrates the step of applying a reflective surface 532 to center portion 522 and a reflective surface 536 to grating 512. Representatively, in one embodiment, reflective surfaces 532 and 536 are formed by introducing a reflective material 530 (e.g. gold coating) from above back plate layer 518 and through the openings in back plate layer 518 and compliant membrane layer 508 in a manner that allows material 530 to coat center portion 522 and grating 512. In this aspect, top side metallization may be used to form the reflective surfaces. Since top side metallization can be used, masking steps typically used for bottom side metallization techniques are not necessary.

Once each of the layers necessary for operation of microphone 500 are formed, an emitter (e.g. emitter 124) and detector (e.g. detector 126) can be positioned on substrate 502, for example on base portion 503, such that they are aligned with grating 512 and reflective surface 532 formed on center portion 522. In one embodiment, emitter and detector may be formed monolithically on another substrate using standard MEMS processing techniques, and then positioned within or on substrate base portion 503. Microphone 500 may then be mounted within an enclosure (e.g. enclosure 120) which can in turn be mounted within the desired electronic device. In addition, any circuitry (e.g. wires) connected to the various microphone components, for example, the emitter or the detector may be pre-formed within substrate 502 such that when the components are formed, the circuitry is connected to the components.

Figure 6:
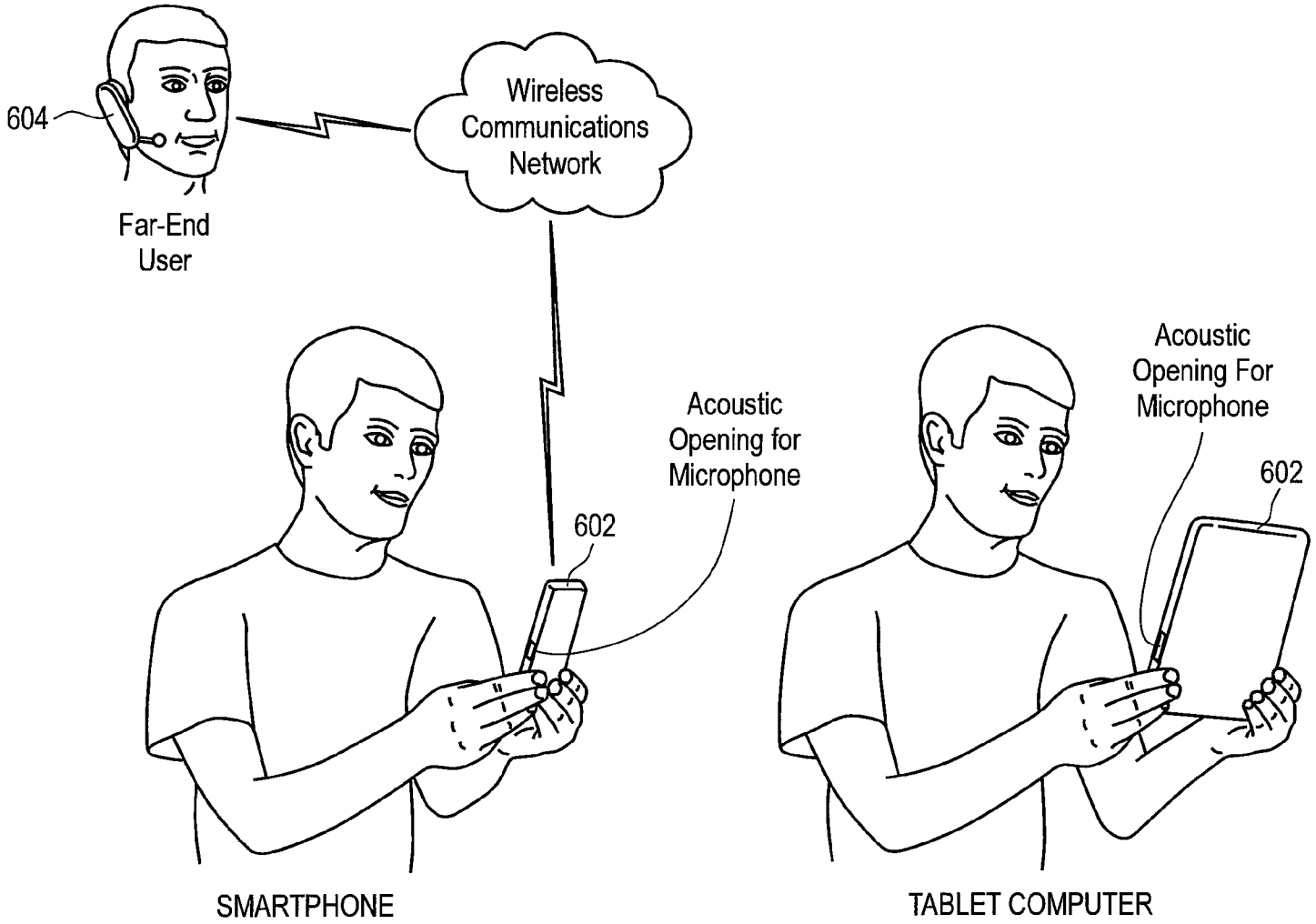
FIG. 6 illustrates one embodiment of a simplified schematic view of one embodiment of an electronic device in which the optical microphone may be implemented.

FIG. 6 illustrates one embodiment of a simplified schematic view of one embodiment of an electronic device in which a MEMS optical microphone, or other MEMS device described herein, may be implemented. As seen in FIG. 6, the MEMS device may be integrated within a consumer electronic device 602 such as a smart phone with which a user can conduct a call with a far-end user of a communications device 604 over a wireless communications network; in another example, the MEMS device may be integrated within the housing of a tablet computer. These are just two examples of where the MEMS device described herein may be used, it is contemplated, however, that the MEMS device may be used with any type of electronic device in which a MEMS device, for example, an optical MEMS microphone, is desired, for example, a tablet computer, a desk top computing device or other display device.

Figure 7:
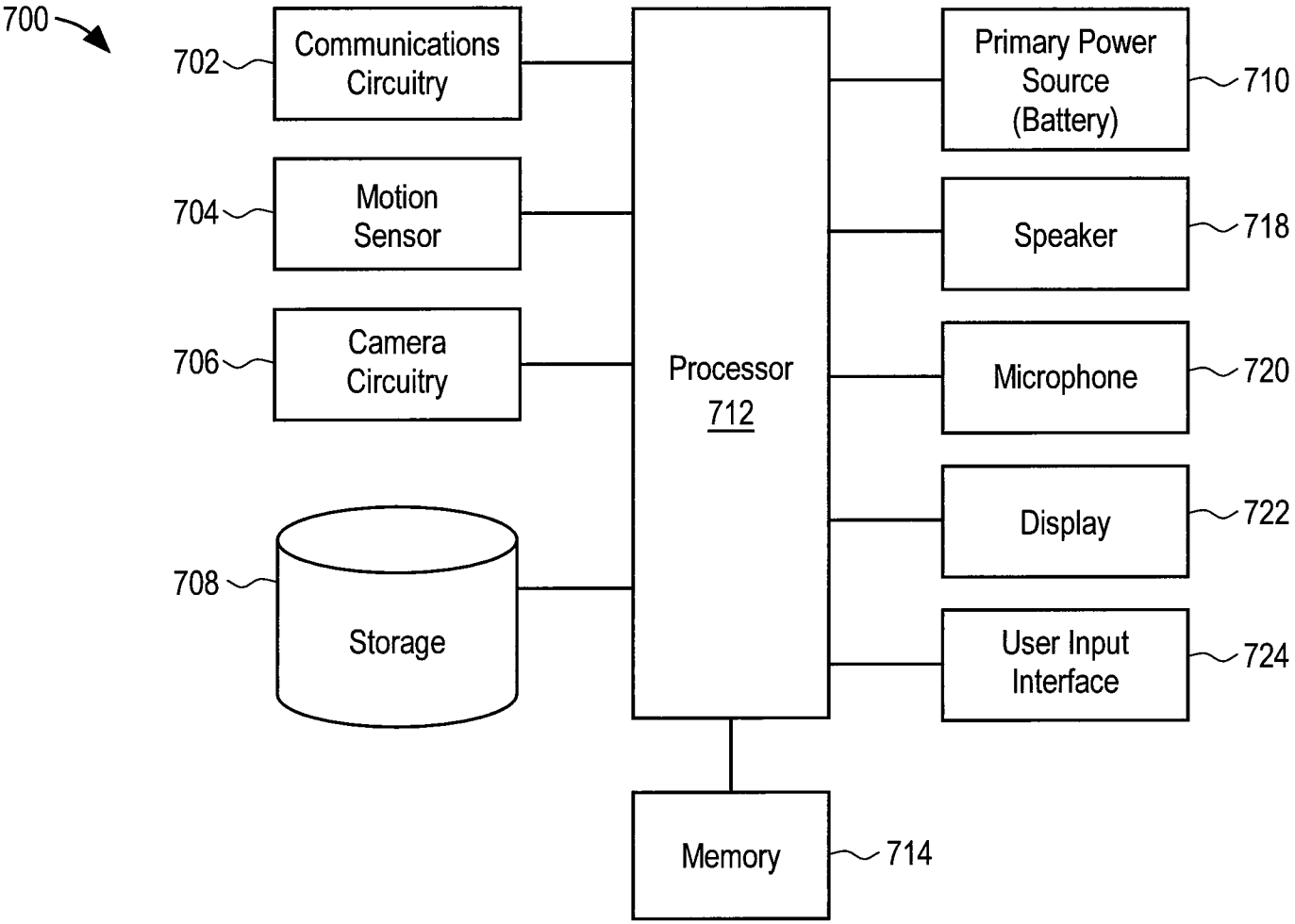
FIG. 7 illustrates a block diagram of some of the constituent components of an embodiment of an electronic device in which an embodiment of the invention may be implemented.

FIG. 7 illustrates a block diagram of some of the constituent components of an embodiment of an electronic device in which an embodiment of the invention may be implemented. Device 700 may be any one of several different types of consumer electronic devices. For example, the device 700 may be any microphone-equipped mobile device, such as a cellular phone, a smart phone, a media player, or a tablet-like portable computer.

In this aspect, electronic device 700 includes a processor 712 that interacts with camera circuitry 706, motion sensor 704, storage 708, memory 714, display 722, and user input interface 724. Main processor 712 may also interact with communications circuitry 702, primary power source 710, speaker 718, and microphone 720. Microphone 720 may be an optical microphone such as optical microphone 100 such as that described in reference to FIG. 1. The various components of the electronic device 700 may be digitally interconnected and used or managed by a software stack being executed by the processor 712. Many of the components shown or described here may be implemented as one or more dedicated hardware units and/or a programmed processor (software being executed by a processor, e.g., the processor 712).

The processor 712 controls the overall operation of the device 700 by performing some or all of the operations of one or more applications or operating system programs implemented on the device 700, by executing instructions for it (software code and data) that may be found in the storage 708. The processor 712 may, for example, drive the display 722 and receive user inputs through the user input interface 724 (which may be integrated with the display 722 as part of a single, touch sensitive display panel). In addition, processor 712 may send an audio signal to speaker 718 to facilitate operation of speaker 718.

Storage 708 provides a relatively large amount of "permanent" data storage, using nonvolatile solid state memory (e.g., flash storage) and/or a kinetic nonvolatile storage device (e.g., rotating magnetic disk drive). Storage 708 may include both local storage and storage space on a remote server. Storage 708 may store data as well as software components that control and manage, at a higher level, the different functions of the device 700.

In addition to storage 708, there may be memory 714, also referred to as main memory or program memory, which provides relatively fast access to stored code and data that is being executed by the processor 712. Memory 714 may include solid state random access memory (RAM), e.g., static RAM or dynamic RAM. There may be one or more processors, e.g., processor 712, that run or execute various software programs, modules, or sets of instructions (e.g., applications) that, while stored permanently in the storage 708, have been transferred to the memory 714 for execution, to perform the various functions described above.

The device 700 may include communications circuitry 702. Communications circuitry 702 may include components used for wired or wireless communications, such as two-way conversations and data transfers. For example, communications circuitry 702 may include RF communications circuitry that is coupled to an antenna, so that the user of the device 700 can place or receive a call through a wireless communications network. The RF communications circuitry may include a RF transceiver and a cellular baseband processor to enable the call through a cellular network.

For example, communications circuitry 702 may include Wi-Fi communications circuitry so that the user of the device 700 may place or initiate a call using voice over Internet Protocol (VOIP) connection, transfer data through a wireless local area network.

The device may include a microphone 720. Microphone 720 may be a MEMS optical microphone such as that described in reference to FIG. 1. In this aspect, microphone 720 may be an acoustic-to-electric transducer or sensor that converts sound in air into an electrical signal. The microphone circuitry (e.g. circuit 128) may be electrically connected to processor 712 and power source 710 to facilitate the microphone operation (e.g. tilting).

The device 700 may include a motion sensor 704, also referred to as an inertial sensor, that may be used to detect movement of the device 700. The motion sensor 704 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 704 may be a light sensor that detects movement or absence of movement of the device 700, by detecting the intensity of ambient light or a sudden change in the intensity of ambient light. The motion sensor 704 generates a signal based on at least one of a position, orientation, and movement of the device 700. The signal may include the character of the motion, such as acceleration, velocity, direction, directional change, duration, amplitude, frequency, or any other characterization of movement. The processor 712 receives the sensor signal and controls one or more operations of the device 700 based in part on the sensor signal.

The device 700 also includes camera circuitry 706 that implements the digital camera functionality of the device 700. One or more solid state image sensors are built into the device 700, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 708. The camera circuitry 706 may also be used to capture video images of a scene.

Device 700 also includes primary power source 710, such as a built in battery, as a primary power supply.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the devices and processing steps disclosed herein may correspond to any type of optical sensor that could benefit from a substantially open back plate positioned over a compliant membrane having a grating, for example, an inertial sensor, an accelerometer, a gyrometer or the like. The description is thus to be regarded as illustrative instead of limiting.

What is claimed is:

1. A micro-electro-mechanical system (MEMS) optical microphone comprising:

a substrate;

a compliant bottom plate positioned above the substrate, the bottom plate configured to vibrate in response to an acoustic wave and having a grating suspended therein;

a rigid top plate positioned above the bottom plate, the top plate having a reflector suspended therein;

a light emitter positioned on the substrate, the light emitter configured to transmit a laser light toward the grating and the reflector; and a light detector positioned on the substrate, the light detector configured to detect an interference pattern of the laser light after reflection from the reflector, wherein the interference pattern is indicative of an acoustic vibration of the bottom plate.

2. The MEMS optical microphone of claim 1 wherein the grating is suspended within the bottom plate by a spring.

3. The MEMS optical microphone of claim 2 wherein the spring is configured to reduce a tension on the grating.

4. The MEMS optical microphone of claim 1 wherein the grating is suspended within a center portion of the bottom plate.

5. The MEMS optical microphone of claim 1 wherein the bottom plate comprises an opening formed around the grating.

6. The MEMS optical microphone of claim 1 wherein an area around the reflector comprises a plurality openings, and wherein each opening is defined by a space between two spokes that extend from the reflector to a periphery or boundary portion of the top plate that is affixed to a support member.

7. The MEMS optical microphone of claim 1 wherein the reflector is within the same plane as the top plate.

8. The MEMS optical microphone of claim 1 wherein the reflector is suspended within a frame of the top plate by a plurality of spokes.

9. A micro-electro-mechanical system (MEMS) optical microphone comprising:

a substrate;

a diaphragm positioned above the substrate, the diaphragm having a spring suspended grating formed therein;

a back plate positioned above the diaphragm, the back plate having an opening, and a reflector is suspended within the opening by a plurality of spokes;

a light emitter positioned below the diaphragm, the light emitter configured to transmit a laser light through the grating and toward the reflector; and a light detector positioned below the diaphragm, the light detector configured to detect an interference pattern of the laser light after reflection from the reflector.

10. The MEMS optical microphone of claim 9 wherein the grating is larger than the reflector.

11. The MEMS optical microphone of claim 9 wherein an area of the back plate around the reflector is substantially open such that the reflector and the grating can be visually aligned from a top side of, or above, the back plate.

12. The MEMS optical microphone of claim 9 wherein the back plate comprises a frame from which the reflector is suspended within a plane of the back plate by the plurality of spokes.

13. The MEMS optical microphone of claim 9 wherein the back plate and the reflector are substantially rigid structures.

14. A method of manufacturing a micro-electro-mechanical system (MEMS) optical microphone comprising:

providing a substrate;

forming a compliant membrane over the substrate, the compliant membrane having a grating;

forming a rigid back plate over the compliant membrane, the back plate having an inner plate suspended from an outer portion of the back plate; and applying a reflective coating to the grating and the inner plate by introducing a reflective coating material from a top side of the back plate.

15. The method of claim 14 wherein an opening is formed around the inner plate such that the reflective coating material passes through the back plate to the compliant membrane.

16. The method of claim 14 wherein forming the compliant membrane comprises forming a suspension member around the grating, wherein the suspension member is configured to reduce a tension on the grating.

17. The method of claim 16 wherein the suspension member is a spring.

18. The method of claim 14 wherein forming the back plate comprises forming a spoke within the back plate for suspension of the inner plate within a center portion of the back plate.

19. The method of claim 14 wherein the compliant membrane and the back plate are formed such that the grating and the inner plate are vertically aligned.

20. The method of claim 14 wherein the substrate is a single substrate upon which the compliant membrane and the back plate are both formed.

* * * * *